United States Patent [19]

Moriya

[11] Patent Number: 4,526,475

[45] Date of Patent: Jul. 2, 1985

[54] ANALOG DISPLAY ELECTRONIC TIMEPIECE WITH MULTI-SPEED HAND MOVEMENT

[75] Inventor: Tatsuo Moriya, Suwa, Japan

[73] Assignee: Kabushiki Kaisha Suwa Seikosha, Tokyo, Japan

[21] Appl. No.: 510,849

[22] Filed: Jul. 5, 1983

[30] Foreign Application Priority Data

Jul. 15, 1982 [JP] Japan ..... 57-123336

[51] Int. Cl.[3] ..... G04F 5/00

[52] U.S. Cl. ..... 368/157; 368/80; 368/160

[58] Field of Search ..... 368/156, 157, 155, 160, 368/200-202, 203, 76, 80, 107-109; 318/696

[56] References Cited

U.S. PATENT DOCUMENTS 4,290,129 9/1981 Ushikoshi ..... 368/203

4,407,019 9/1983 Futami et al. ..... 368/200

FOREIGN PATENT DOCUMENTS 2027235 2/1980 United Kingdom .

*Primary Examiner*—Bernard Roskoski

*Attorney, Agent, or Firm*—Blum Kaplan Friedman Silberman & Beran

[57] ABSTRACT

An electronic analog display timepiece provides multi-functions wherein the hand, or hands, is driven at different frequencies. To prevent erroneous performance of the step motor, an interval longer than the period of damped oscillation of the step motor is provided when the step motor driving frequency changes by synchronizing the lower frequency driving signals with the signal of the highest frequency of the circuit. Alternatively, one pulse of the second frequency signal is eliminated when switching from the first to the second frequency signal.

5 Claims, 10 Drawing Figures

ANALOG DISPLAY ELECTRONIC TIMEPIECE WITH MULTI-SPEED HAND MOVEMENT

BACKGROUND OF THE INVENTION

This invention relates generally to an electronic timepiece of the analog type having hands driven by a step motor, and more particularly to an electronic analog timepiece where the hands or hand are driven at more than one frequency. Changing the driving frequency of the step motor is an important means to multiply the number of functions performable by the timepiece. For example, where a pair of hands, or one hand, has two functions A,B, the hands must be driven to indicate the proper position more quickly than normal when the functions switch over between A and B. For another example, where a pair of hands, or one hand, has a stopwatch function, another function such as a split time display, that is, an intermediate elapsed time display, can be achieved by driving the hand to indicate a desired position more quickly than in normal operation.

In order to have the capability to drive the step motor at different speeds, it is preferable in design to have available within the circuit driving pulses of different frequencies from which a control circuit selects the suitable frequency in accordance with the function to be performed. FIG. 1 illustrates waveform timing when the driving pulse switches over from a 16 Hz frequency P16 to a 1 Hz frequency P1. In FIG. 1, if an interval T between the end of the pulses P16 and the start of the pulses P1 is less than the period of damped oscillation of the step motor, the step motor is not likely to operate properly on the first pulse of the new frequency. Erroneous performance of the step motor directly induces significant defects such as inaccuracy in the indicated position of the hand.

A stop watch is an excellent example of a multifunctional analog timepiece wherein the indicating hand is driven at more than one frequency. Typically, the hand is driven at an accelerated pace in return-to-zero after a time has been measured or for achieving an accurate position after a split command has been released. Because commands are input through external switches by the user, synchronization is lacking between the switch input and the different frequency signals operating within the circuit. Accordingly, it sometimes happens that the demands for driving the hands are very close together in time when switching over between frequency signals. If this period between driving pulses is shorter than the period of damped oscillation of the step motor, then erroneous performance of the step motor may be induced.

What is needed is an electronic analog timepiece driving a hand or hands with a step motor, which can switch the hand driving frequency without inducing errors in hand position.

SUMMARY OF THE INVENTION

Generally speaking, in accordance with the invention, an electronic analog display timepiece especially suitable for multifunctions wherein the hand or hands are driven at different frequencies is provided. In order to prevent erroneous performance of the step motor, an interval longer than the period of damped oscillation of the step motor is always provided when the frequency of the step motor driving pulses changes. This is accomplished by synchronizing the lower frequency driving signals with the signal of the highest frequency of the circuit. In an alternative embodiment one pulse of the second frequency signal is eliminated when switching from the first to the second frequency signal.

Accordingly, it is an object of this invention to provide an improved analog display electronic timepiece wherein erroneous performance of the step motor is avoided in switching between different hand driving frequencies.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in claims.

BRIEF DESCRIPTION OF THE DRAWINGS

For a fuller understanding of the invention, reference is had to the following description taken in connection with the accompanying drawings in which:

FIG. 2(*b*) is a circuit of a step motor driving pulse generator for the construction of FIG. 2(*a*);

DESCRIPTION OF THE PREFERRED EMBODIMENTS

This invention relates to an analog timepiece using a step motor to drive hands wherein the step motor must operate on at least two different frequencies. This invention is described hereinafter with reference to embodiments of an analog display electronic stopwatch whose hands have functions for return-to-zero and for providing a split time display in addition to the measurement of elapsed time.

Figure 1:
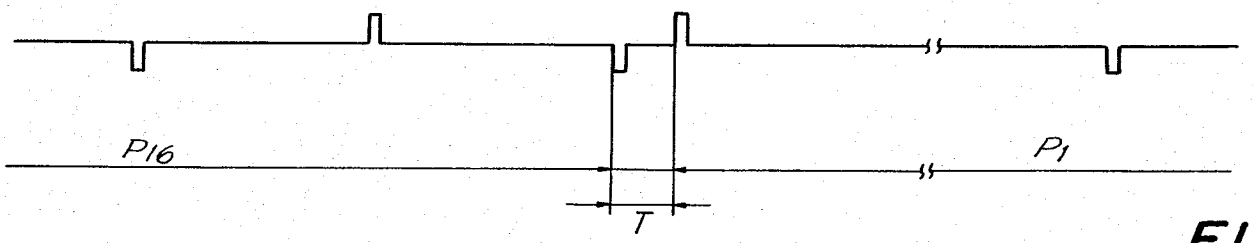
FIG. 1 is a timing chart indicating step motor driving pulses where different driving frequencies switch over.
Figure 2A:
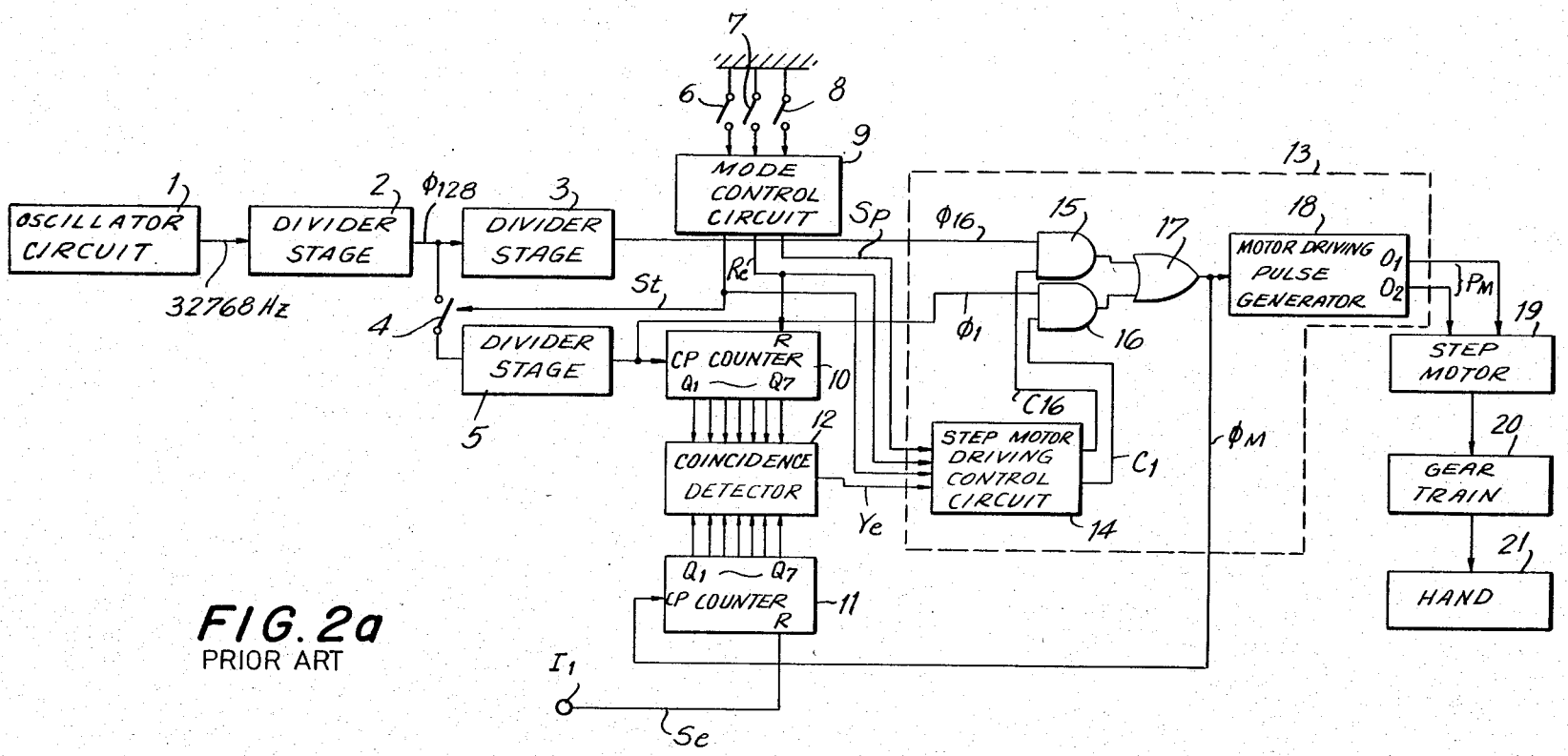
FIG. 2a PRIOR ART
FIG. 2(*a*) is a functional block diagram of an analog display stopwatch for displaying time in seconds including hands having a return-to-zero function and a split time display function.

FIG. 2*a* is a block diagram of a circuit and mechanical means for displaying time in seconds. In FIG. 2*a*, an oscillator circuit 1, including a quartz crystal resonator, provides an output signal of 32,768 Hz which is divided down in a divider network 2 to provide an output signal $\phi$128 of 128 Hz. The divided signal $\phi$128 is input to a divider network 3 which in turn divides down the signal $\phi$128 and outputs a 16 Hz signal $\phi$16.

A switch 4 is closed only when a start/stop signal St output from a mode control circuit 9 is in a high state. When the switch 4 is closed, a divider network 5 divides down the 128 Hz signal $\phi$128 to provide an output signal having a repetition frequency of 1 Hz which is used as a time measurement standard. The mode control circuit 9 outputs a start/stop signal St for commanding the start and stop of time measurement, a split signal Sp for commanding display of an intermediate elapsed time, hereinafter referred to as the split time, and a release of display and reset signal for commanding a return-to-zero of the hand.

By operating an external operating member 6, the logic state of the start/stop signal St changes cyclically. When the logic state of the start/stop signal St is high, time measurement commences. A split signal Sp is normally in the low state and by operating an external operating member 8 when the start/stop signal St is high, the logic state of the split signal Sp changes cyclically. When the split signal Sp is high, the split time display is commanded, and at the time when Sp falls from high to low, the split time display is released.

A reset signal Re is normally in a low state and by operating an external operating member 7, changes momentarily to a high state to command the hands to return-to-zero. When the reset signal Re goes high, the start/stop signal St and the split signal Sp go low.

A counter 10 is a 1/60 counter for counting the 1 Hz signal $\phi$1 as a time measurement standard, and the counter 10 is reset when the reset signal Re output from the mode control circuit 9 is high. A counter 11 is a 1/60 counter for counting the motor driving signal $\phi$M so as to store the information indicating the dial position indicated by a hand 21. The counter 11 is reset by a signal Se for storing the zero-position of the hand which is input to a terminal I1. The logic states of outputs of counter 10 and counter 11 change in response to the fall of clock pulses applied thereto. A coincidence detector 12 compares the contents of the counter 10 and the counter 11 and outputs a coincidence signal Ye which goes high when coincidence between the contents of the counters 10, 11 is detected.

A step motor driver system 13 comprises a motor driving control circuit 14, AND gates 15, 16, OR gate 17, and a driving pulse generator 18. The step motor driving control circuit 14 provides dual outputs, that is, signals C16 and C1 for selecting respectively either a 16 Hz signal $\phi$16 or a 1 Hz signal $\phi$1 as the motor driving signal $\phi$M. The signal C16 is high when the coincidence signal Ye output from the coincidence detector 12 is low and the split signal Sp is low. The signal C1 is high when the start/stop signal St is high and the split Sp is low and the coincidence signal Ye is high. Thus, during normal time measurement, that is when the start/stop signal St is high and the split signal Sp is low and the coincidence signal Ye is high, the motor driving control circuit 14 outputs the signal C1 for selecting a 1 Hz signal $\phi$1. On the other hand, the step motor driving control circuit 14 outputs the signal C16 for selecting the 16 Hz signal $\phi$16 when the hand is quickly driven to indicate elapsing time which has been measured, for example, after the split time display is released, or when commencement of time measurement is commanded while the hand is returning-to-zero, and when the hand returns to zero.

A driving pulse generator 18 converts the step motor driving signal $\phi$M into step motor driving pulses PM which advance the step motor 19 which in turn drives a gear train 20. The gear train 20 is constructed so that the hand 21 completes one rotation in sixty steps.

Figure 2B:
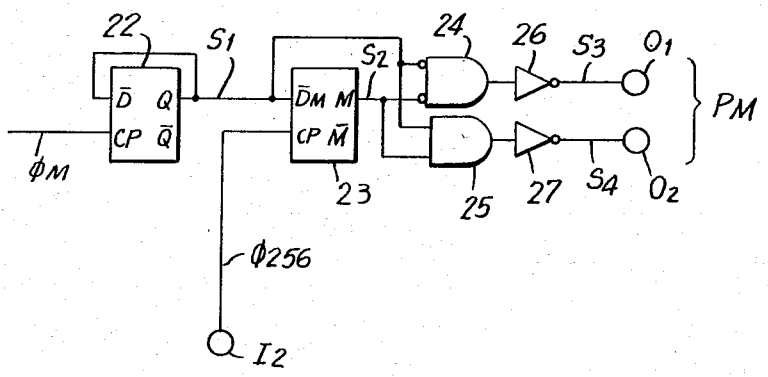
FIG. 2b PRIOR ART

FIG. 2*b* is a circuit diagram for the driving pulse generator 18 of FIG. 2*a*. In FIG. 2*b*, a flip-flop circuit 22 stores information of the polarity of the step motor signal and the logic states of the outputs Q and $\overline{Q}$ of the flip-flop 22 change in response to the fall of the step motor driving signal $\phi$M. A latch circuit 23 delays the output signal of the flip-flop circuit 22 for 3.9 msec by means of a 256 Hz signal input to the terminal I2 to clock the latch circuit 23. Outputs of the flip-flop 22 and latch circuit 23 are fed to an AND gate 24 with inverted inputs and an AND gate 25. Thus, step motor driving pulses PM having a pulse width of 3.9 msec are output from terminals O1 and O2 alternately. Drivers 26, 27 assure sufficient current to drive the step motor 19.

By the constructions illustrated in FIGS. 2*a*, 2*b*, a hand displaying time in seconds is driven at a rate of one step of motion per 1 Hz during normal time measurement. The hand stops during split time display and is driven at 16 Hz, that is, quickly driven, once the hand is released to indicate elapsing time which is being measured. The hand is also driven at 16 Hz when returning to zero.

Figure 3:
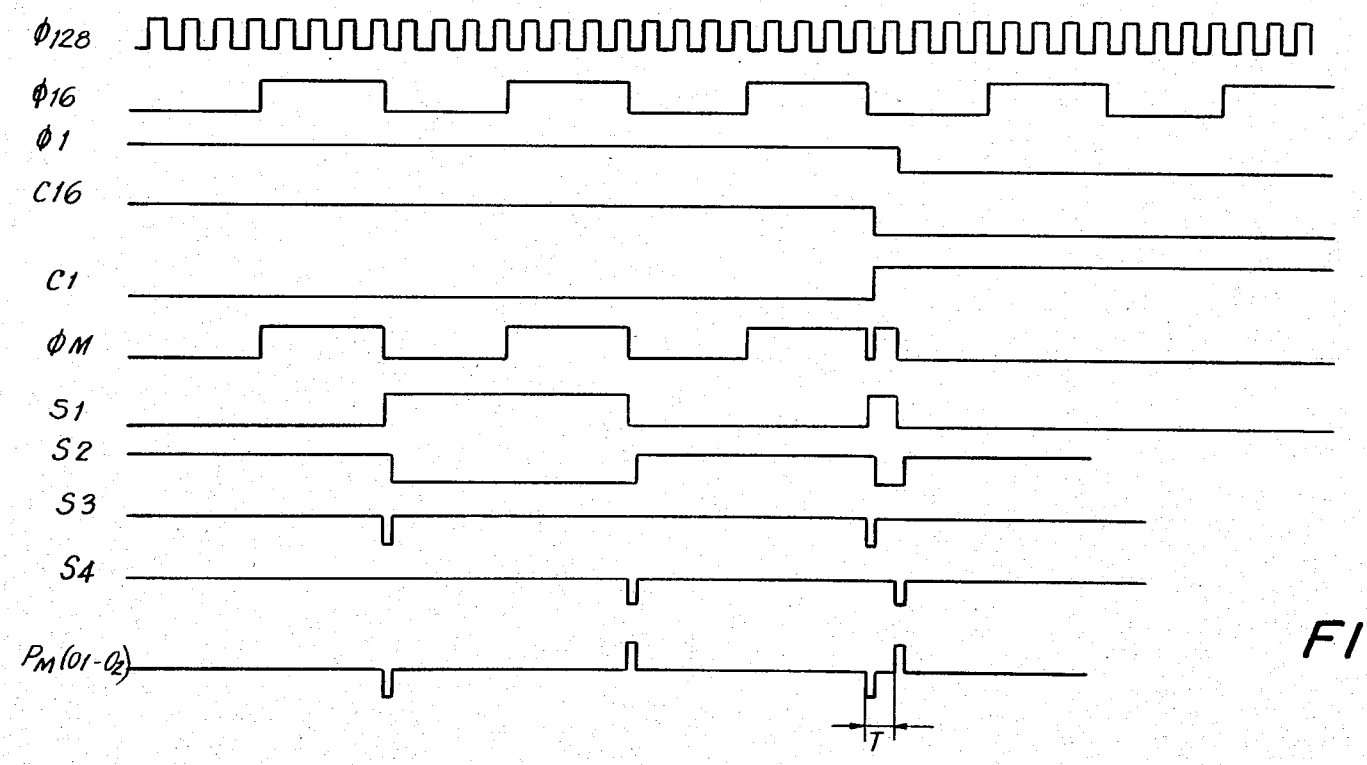
FIG. 3 is a time chart of signals associated with the construction of FIG. 2.

In FIG. 2*a*, however, the timing at which a start/stop signal St goes high and the switch 4 closes is irregular because a manual operation is involved. Accordingly, the time when the 16 Hz signal $\phi$16 falls until a 1 Hz signal $\phi$1 falls, and the time when a 1 Hz signal $\phi$1 falls until a 16 Hz signal $\phi$16 falls are variable times. FIG. 3 is a timing chart illustrating the relationship between signals produced in the construction of FIGS. 2*a*, *b*, in a situation where the switch 4 closes at the moment when the 16 Hz signal $\phi$16 falls.

Also, FIG. 3 illustrates the situation where signal C16 and C1, selecting respectively a 16 Hz signal $\phi$16 and a 1 Hz signal $\phi$1 as a step motor driving signal $\phi$M, switch over. That is, the situation where a split time display is released and the elapsing time which is being measured is indicated, or time measurement is recommenced while the hand returns to zero and elapsing time which is being measured is indicated.

As illustrated in FIG. 3, an interval T between the step motor driving pulses PM of 16 Hz and 1 Hz is 1/128 sec≅7.8 msec. The damped oscillation period of a frequently used step motor is 20 to 30 msec for a motor having two stator pieces surrounding the rotor, and 40 to 50 msec for a step motor having one stator piece surrounding the rotor. It should be understood that these values vary somewhat with the motor source. Therefore, in a situation where the step motor driving pulse switches over from one frequency to the other as illustrated in FIG. 3, the step motor is very likely to perform erroneously.

Figure 4:
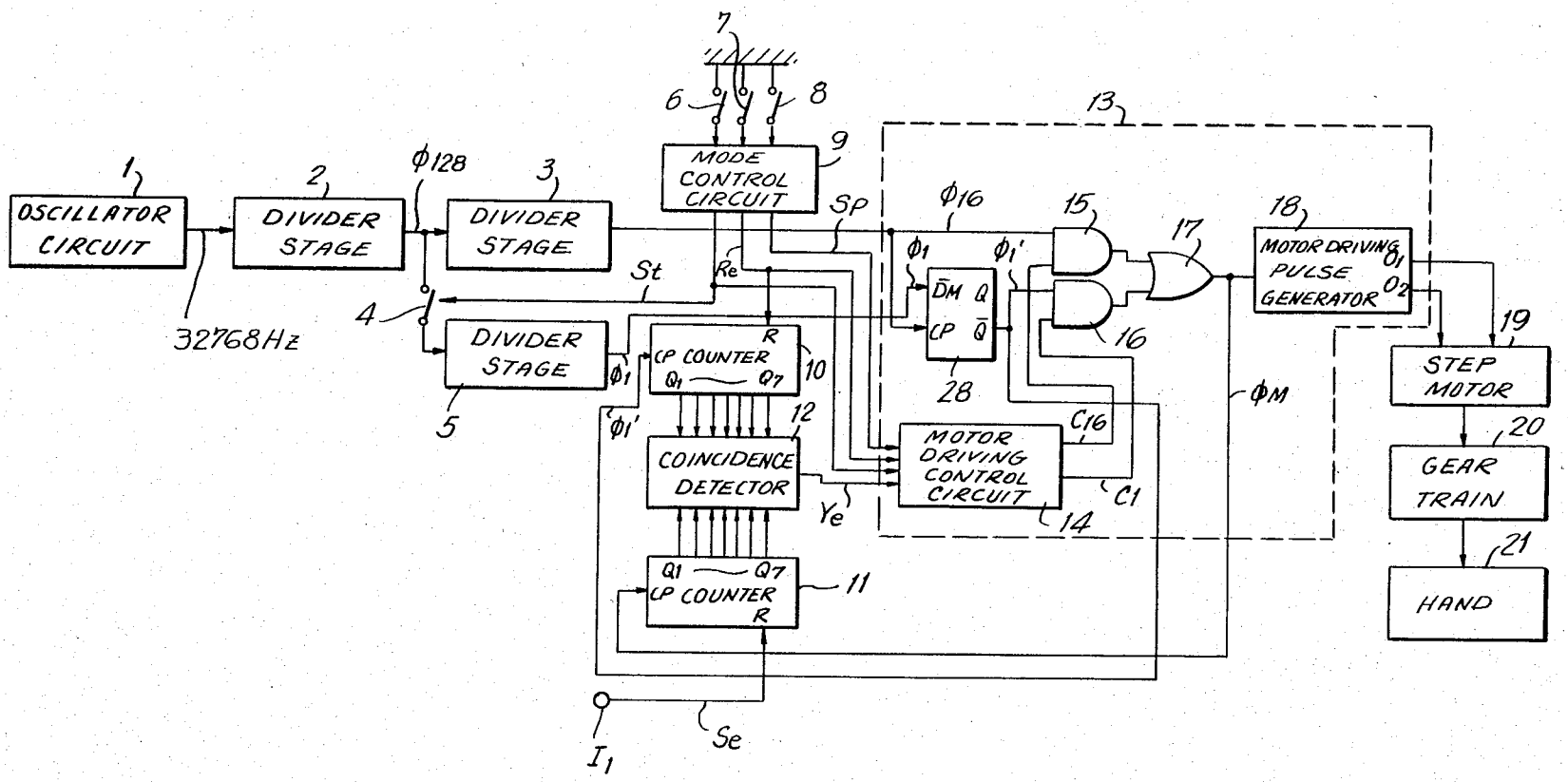
FIG. 4 is a functional block diagram of an analog display stopwatch in accordance with the invention for displaying time in seconds and including hands having a return-to-zero function and a split time display function.
Figure 5:
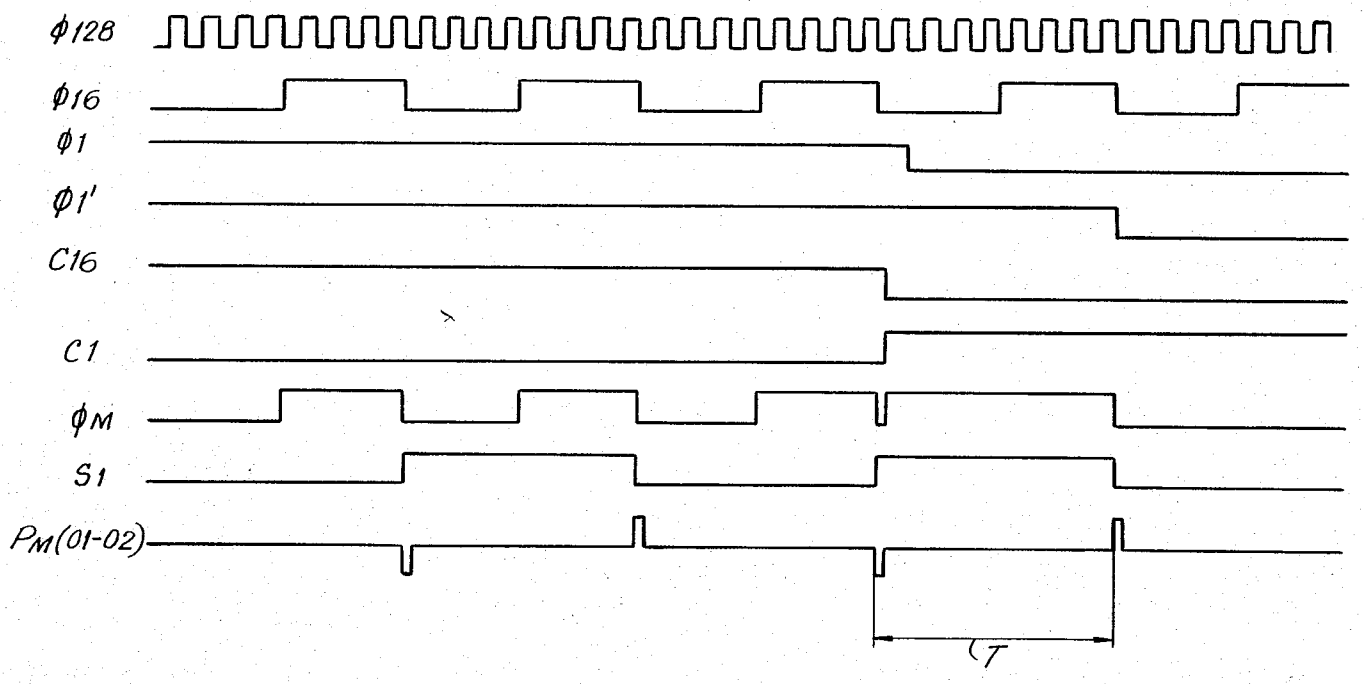
FIG. 5 is a timing chart of signals associated with the construction of FIG. 4.

FIG. 4 is a block diagram of circuits and mechanical constructions for displaying time in seconds in accordance with this invention. One difference between the constructions of FIG. 2 and FIG. 4 is that in FIG. 4, a flip-flop circuit 28 is incorporated into the step motor driver circuit 13 and the counter 10 counts an output signal $\phi$1′ from the flip-flop circuit 28. FIG. 5 is a timing chart of signals produced in the construction illustrated in FIG. 4. An output signal $\phi$1′ from the flip-flop circuit 28 is synchronized with a 16 Hz signal $\phi$16. Therefore, even if signals C16 and C1, which respectively select the 16 Hz signal $\phi$16 or the 1 Hz signal $\phi$1 as the step motor driving signal $\phi$M, switch over at the same timing as illustrated in FIGS. 3, 5, an interval between the two step motor driving pulses PM of 16 Hz and 1 Hz is 1/16 sec=62.5 msec, or greater. As noted above, because the damped oscillation period of the step motor generally is at most 50 msec, erroneous motor performance is unlikely to occur.

As illustrated in FIG. 4, by constructing the step motor driver circuit so that different step motor driving signals are synchronized with the one signal having the highest frequency among them, at the time when the step motor driving signal switches from one to another, the interval between the two different driving pulses is greater than one period of the step motors driving signal having the highest frequency. Because the interval between the signals is necessarily longer than the damped oscillation period of the step motor, erroneous performance of the step motor is not likely to occur.

In the embodiment of the timepiece in accordance with the invention described above, the step motor driving signal $\phi$1 is synchronized with another step motor driving signal of higher frequency $\phi$16 for the sake of an example. However, each of the two signals is able to be synchronized with another signal of still higher frequency. For example, when a 16 Hz signal $\phi$16 and a 1 Hz signal $\phi$1 are synchronized with a 32 Hz signal, an interval between the step motor driving pulses of 16 Hz and 1 Hz is 31.25 msec, that is, the period of the higher 32 Hz signal. Therefore, by using a step motor with two stator pieces surrounding the rotor, erroneous performance of the step motor is avoided in this case.

Figure 6:
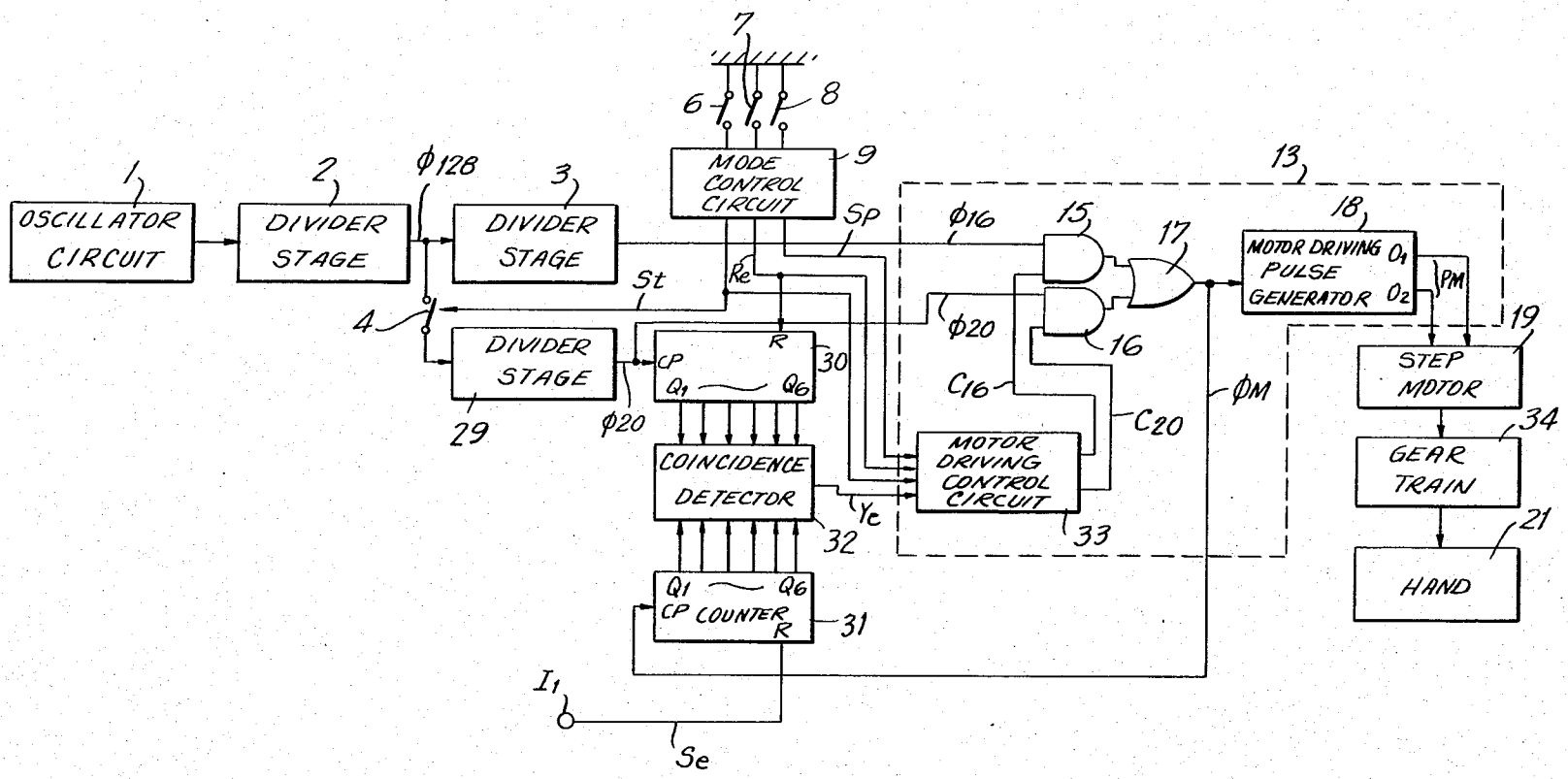
FIG. 6 PRIOR ART
FIG. 6 is a functional block diagram of an analog display stopwatch for displaying time in 1/20 seconds units and having a return-to-zero function and a split time display function.

An alternative embodiment of a timepiece in accordance with the invention is illustrated with reference to FIG. 6. This block diagram illustrates a circuit and mechanical construction for displaying time in units of 1/20th of a second. In FIG. 6, only a divider network 29, counter 30, counter 31, coincidence detector 32, step motor driving control circuit 33, and gear train 34 are different from the corresponding elements in FIG. 2. With the switch 4 closed, the divider network 29 divides down the 128 Hz signal $\phi$128 into a 20 Hz signal $\phi$20 by combining dividing rates of 1/6 and 1/7. The counter 30 is a 1/20 counter for counting the 20 Hz signal $\phi$20 as the time measurement standard signal and the counter 30 is reset when a reset signal Re for commanding the hands to return to zero, goes high.

The other counter 31 is a 1/20 counter for counting the step motor driving signal pulses $\phi$M, and counter 31 is reset in response to a signal Se for storing information of the zero position of the hand. The signal Se is input to a terminal I1. The step motor driving control circuit 33 generates a signal C20 for selecting the 20 Hz signal $\phi$20 which goes high when a start/stop signal St is high and the split signal Sp is low, and the coincidence signal Ye is high. The step motor driving control circuit 33 generates a signal C16 for selecting the 16 Hz signal $\phi$16 which goes high when the start/stop signal St is low and the coincidence signal Ye is low. The gear train 34 is constructed so that the hand 21 completes one rotation with twenty steps.

By the construction illustrated in FIG. 6, the hand is driven at 20 Hz frequency during normal time measurement and stops when a split time display is commanded. From the release of the display until the position indicated by the hand coincides with the elapsing time which is being measured. And when returning-to-zero, the hand is driven at 16 Hz.

In FIG. 6, however, intervals at which the start/stop signal St goes high and the switch 4 closes are irregular. Accordingly, the time from the fall of the 16 Hz signal $\phi$16 until the 20 Hz signal $\phi$20 falls and the time from the fall of the 20 Hz signal $\phi$20 until the 16 Hz signal $\phi$16 falls, are variable.

In the construction of FIG. 6, when signals C16 and C20 for selecting respectively, a 16 Hz signal $\phi$16 and a 20 Hz signal $\phi$20 as the step motor driving signal $\phi$M, switch over from the former to the latter, that is, when time measurement is commenced while the hand is returning to zero, the step motor driving pulse is blocked until the position indicated by the hand coincides with the elapsing time which is being measured. Therefore, erroneous performance of the step motor is not induced in the above case.

Figure 7:
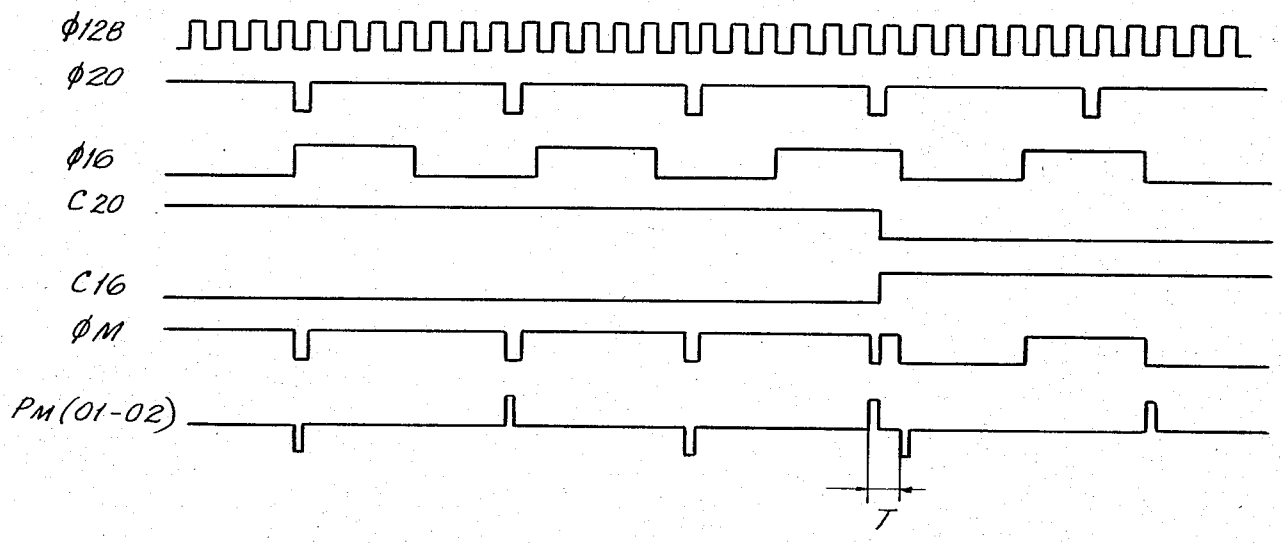
FIG. 7 is a timing chart of signals associated with the construction of FIG. 6.

The timing chart of FIG. 7 shows the situation where signal C20 and C16 for respectively selecting a 20 Hz signal $\phi$20 or a 16 Hz signal $\phi$16 as the step motor driving signal $\phi$M, switch over from the former to the latter, that is, when time measurement is reset. In this situation, at the moment when the signal C16 for selecting the 16 Hz signal $\phi$16 goes from high to low, the signal C20 for selecting the 20 Hz signal $\phi$20 rises from low to high. As illustrated in FIG. 7, an interval T between the two step motor driving pulses PM of 20 Hz and 16 Hz is occasionally shorter than the damped oscillation period of the step motor, which causes the step motor to perform erroneously.

Figure 8:
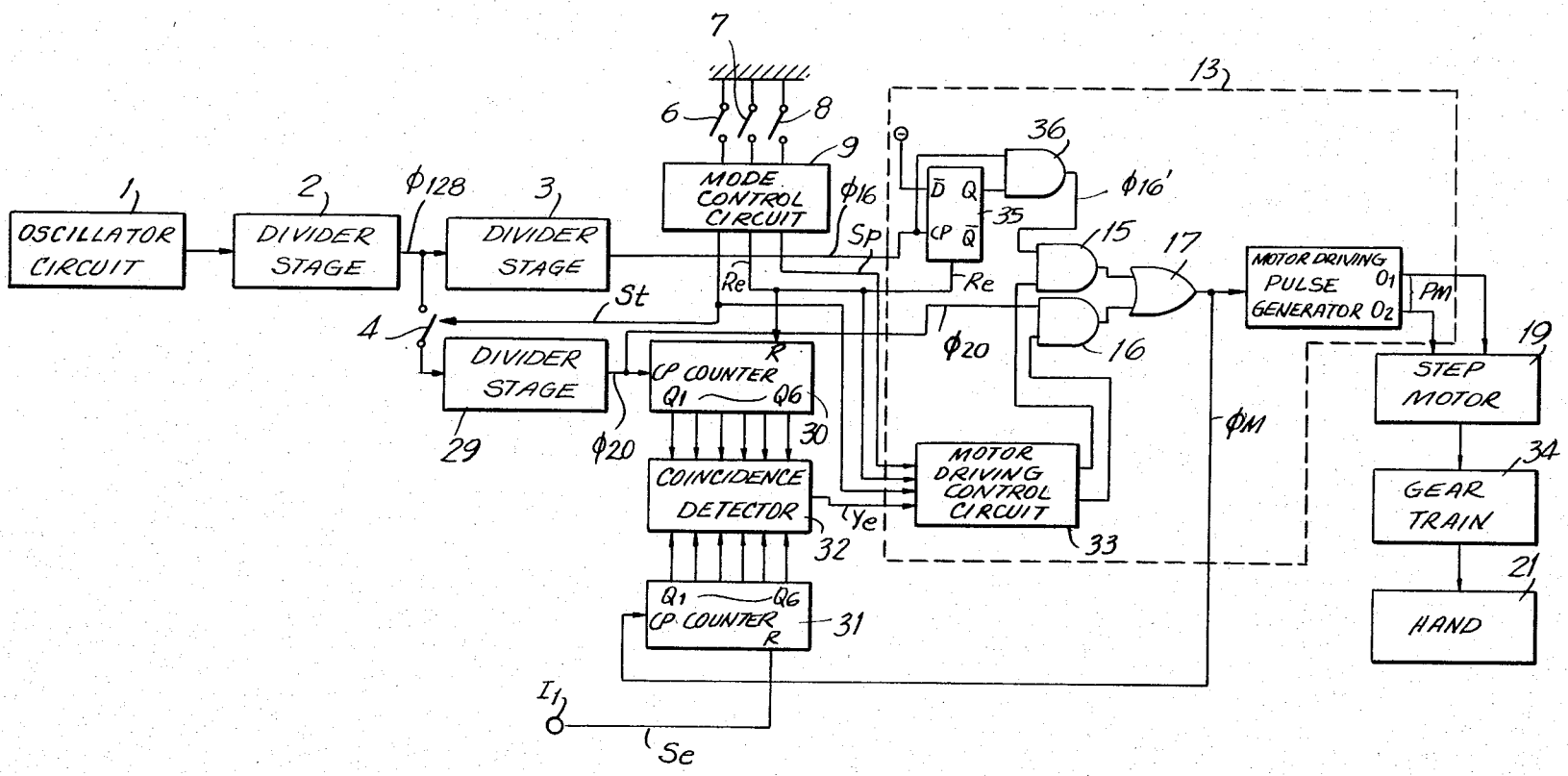
FIG. 8 is a functional block diagram of an analog display electronic timepiece in accordance with the invention for displaying time in 1/20th seconds units and including a hand having a return-to-zero function and a split time display function.

FIG. 8 is a block diagram of circuit and mechanical structure of a timepiece for displaying time in 1/20th second units in accordance with the invention. The embodiment of FIG. 8 is constructed to eliminate the shortcomings of the construction of FIG. 6. The difference between FIG. 8 and FIG. 6 is that a step motor driver circuit 13 in FIG. 8 includes a flip-flop circuit 35 and an AND gate 36.

Figure 9:
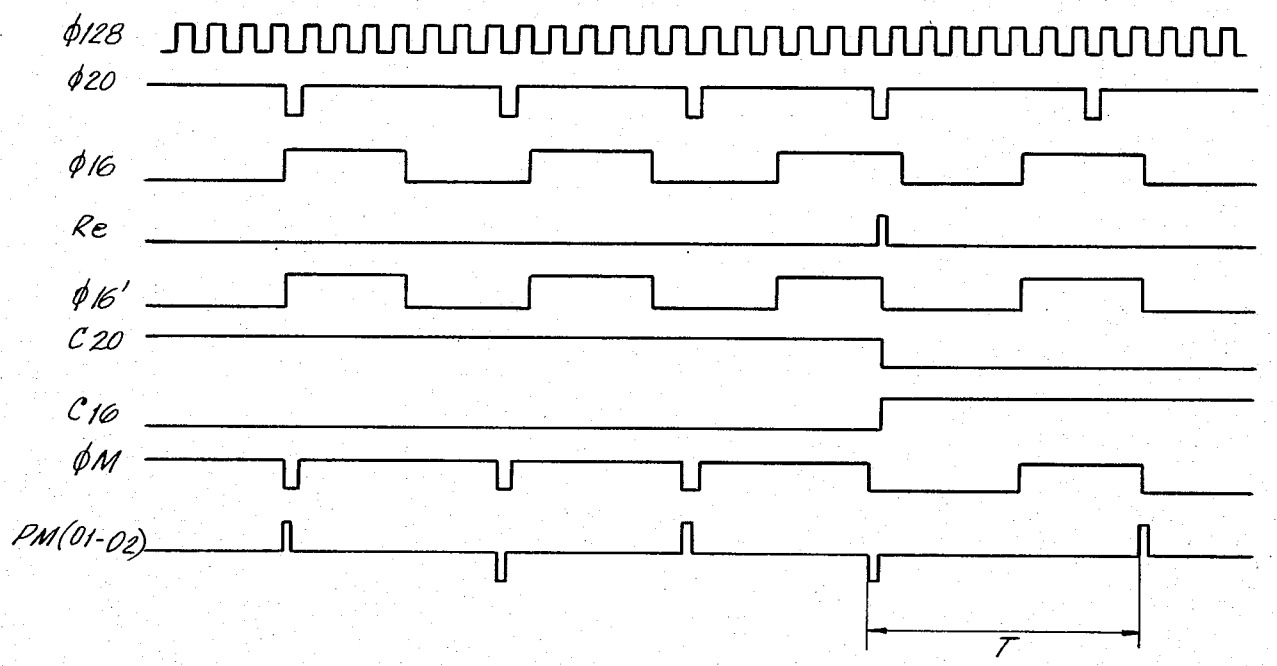
FIG. 9 is a timing chart of signals associated with the construction of FIG. 8.

FIG. 9 is a timing chart of signals produced in the construction of FIG. 8. By this construction, when the reset signal Re goes high with actuation of the external operating member 7, one pulse immediately after the switch over from the signal C20 to the signal C16 is eliminated from the 16 Hz signal $\phi$16. An output Q of the flip-flop circuit 35 is normally high and goes low when the reset signal Re goes high and again becomes high at the moment when the 16 Hz signal $\phi$16 falls to the low level. The output of the flip-flop 35 and the 16 Hz signal $\phi$16 are fed to the AND gate 36 which generates a signal $\phi$16'. The signal $\phi$16' falls to the low level at the time when the reset signal Re goes high. Thus one pulse immediately after the reset signal Re goes high is eliminated from the 16 Hz signal $\phi$16 as illustrated.

Therefor, as illustrated by FIG. 9, even when signal C20 and C16 for respectively selecting a 20 Hz signal $\phi$20 or a 16 Hz signal $\phi$16 as the step motor driving signal $\phi$M, switch over at the same time as illustrated in FIG. 7, an interval between the step motor driving pulses PM of 20 Hz and 16 Hz is always longer in duration than 1/16 sec which=62.5 msec. This is still a longer period than the damped oscillation period of the step motor.

As illustrated by FIG. 8, by constructing the step motor driver circuits so that one pulse is eliminated from the later driving signal immediately after a switch over a frequency from one to the other, the interval between the different step motor driving pulses is longer in duration than one period of the later step motor driving signal. By having this interval longer than the damped oscillation period of the step motor, erroneous performance of the step motor is avoided.

As described above, an analog display electronic timepiece including a step motor driven by driving pulses of different frequencies, is constructed in accordance with the invention so that a longer interval, and a transitional vibrating period for the step motor, is provided between step motor driving pulses. Thus an interval longer than the damped oscillation period of the step motor is provided between step motor driving pulses of different frequencies. Thereby, the step motor is prevented from performing erroneously when the driving frequency changes. Consequently, a multi-functional analog display electronic timepiece of high quality and of high reliability is obtained by this invention.

In the embodiments described above, a stop watch has been described. However, this invention is not limited to a stop watch and other applications such as, for example, a timer, are possible. Also, this invention is applicable to a timepiece including hands having plural functions wherein clock pulses for each function are not synchronized with each other.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed:

1. In an analog timepiece having an oscillator circuit for generating a high frequency standard signal, a first divider network for dividing down said standard signal to a first lower frequency timekeeping signal, a step motor for driving at least one hand of said timepiece, said step motor being subject to damped oscillation after being driven, a driver circuit for receiving said timekeeping signals and outputting driving pulses to said step motor at a frequency corresponding to said timekeeping signal, the improvement therein comprising:

a second divider network receiving inputs derived from said standard signal and outputting a second lower frequency signal, said second frequency signal differing in frequency from said first timekeeping signal;

selection means for determining whether said first or said second lower frequency signal is input to said driver circuit to cause hand motion at a frequency corresponding thereto, said selection means being randomly activated to switch over operation between said lower frequencies;

circuit means for providing a time interval between the last step motor driving pulse at one of said lower frequencies prior to switch over and the first step motor driving pulse at the other one of said lower frequencies after said switch over, said time interval at least equalling the period of said damped step motor oscillation regardless of the ramdom timing of activation of said selection means.

2. An analog timepiece as claimed in claim 1 wherein said time interval less than or equal to the period of the higher frequency of said two lower frequency signals being switched.

3. An analog timepiece as claimed in claim 2, wherein said circuit means for providing a time interval includes a flip-flop circuit, said flip-flop circuit having the lower of said two lower frequency signals input thereto and being clocked by the higher of said two lower frequency signals, the output of said flip-flop circuit changing state on the fall of said clock signal, a delayed output from said flip-flop at said lower frequency being input to said driver circuit.

4. An analog timepiece as claimed in claim 3, wherein said output signal of said flip-flop is synchronized to said higher frequency signal of said two lower frequency signals.

5. An analog timepiece as claimed in claim 1, wherein said circuit means for providing a time interval includes:

a flip-flop circuit having said first lower frequency input thereto as a clock signal, the output of said flip-flop circuit changing state on the fall of said clock signal, said flip-flop circuit being subject to being reset;

an AND gate receiving said lower frequency signal at one input terminal and the output of said flip-flop circuit at the second input terminal, the output of said AND gate being input to said selection means for selective input to said driver circuit, reset of said flip-flop causing a delay in the output from said AND gate of said lower frequency signal, said delay resulting in the loss of one motor driving pulse when said first lower frequency signal is selected for driving said step motor after said reset.

* * * * *